US005082454A

United States Patent [19]

Tonkiss et al.

[11] Patent Number: 5,082,454

[45] Date of Patent: Jan. 21, 1992

[54] TWO-PIECE RETAINING RING

[75] Inventors: David W. Tonkiss, Glendale; Thomas F. Young, Simi Valley, both of Calif.

[73] Assignee: Joslyn Corporation, Chicago, Ill.

[21] Appl. No.: 413,783

[22] Filed: Sep. 28, 1989

[51] Int. Cl.[5] ..... H01R 4/38

[52] U.S. Cl. ..... 439/320; 439/312

[58] Field of Search ..... 439/309-321, 439/607-610

[56] References Cited

U.S. PATENT DOCUMENTS

| | | | |
|---|---|---|---|
| Re. 31,995 | 10/1985 | Ball . | |
| 1,694,354 | 12/1928 | Bollason . | |
| 2,438,107 | 3/1948 | Babbitt . | |
| 2,960,359 | 11/1960 | Leland . | |
| 3,077,811 | 2/1963 | Moore . | |
| 3,446,522 | 5/1969 | Hoard . | |
| 3,601,764 | 8/1971 | Cameron . | |
| 3,611,260 | 10/1971 | Colardeau et al. | 439/317 |
| 3,808,580 | 4/1974 | Johnson | 439/321 |
| 3,853,413 | 12/1974 | Parran . | |
| 3,892,458 | 7/1975 | Clark . | |
| 3,917,373 | 11/1975 | Peterson . | |
| 3,971,614 | 7/1976 | Paoli et al. . | |
| 4,007,953 | 2/1977 | Powell . | |
| 4,030,798 | 6/1977 | Paoli . | |
| 4,066,315 | 1/1978 | Arneson . | |
| 4,074,927 | 2/1978 | Ball . | |
| 4,109,990 | 8/1978 | Waldron et al. . | |
| 4,152,039 | 5/1979 | Shah . | |
| 4,165,910 | 8/1979 | Anderson . | |
| 4,235,498 | 11/1980 | Snyder . | |
| 4,239,314 | 12/1980 | Anderson et al. . | |
| 4,264,116 | 4/1981 | Gliha, Jr. . | |
| 4,268,103 | 5/1981 | Schildkraut et al. . | |
| 4,272,144 | 6/1981 | Brush et al. . | |
| 4,291,933 | 9/1981 | Kakaris . | |
| 4,457,469 | 7/1984 | Ratchford . | |
| 4,484,790 | 11/1984 | Schildkraut et al. . | |
| 4,487,470 | 12/1984 | Knapp et al. . | |
| 4,497,530 | 2/1985 | Shannon . | |
| 4,502,748 | 3/1985 | Brush, Sr. et al. . | |
| 4,519,661 | 5/1985 | Brush, Sr. et al. . | |
| 4,531,801 | 7/1985 | Baur . | |
| 4,548,458 | 10/1985 | Gallusser et al. | 439/312 |
| 4,648,670 | 3/1987 | Punako et al. | 439/321 |
| 4,703,988 | 11/1987 | Raux et al. . | |
| 4,726,782 | 2/1988 | Hager et al. . | |
| 4,746,303 | 5/1988 | Cobraiville et al. | 439/321 |
| 4,820,184 | 4/1989 | Brandes . | |
| 4,834,667 | 5/1989 | Fowler et al. | 439/321 |

FOREIGN PATENT DOCUMENTS

| | | |
|---|---|---|
| 469020 | 9/1913 | France . |
| 1195451 | 4/1958 | France . |

*Primary Examiner*—David L. Pirlot

*Attorney, Agent, or Firm*—Mason, Kolehmainen, Rathburn & Wyss

[57] ABSTRACT

A two-piece retaining ring assembly axially secures a coupling nut to a tubular sleeve and includes a C-shaped retaining ring and a keeper, both formed from a non-metallic composite material. An annular groove is formed on the inside surface of the coupling nut for receiving the retaining ring. The width of the gap defined between the ends of the retaining ring is such to allow the retaining ring to be pulled apart enough slipped over the annular shoulder on the tubular member and resilient enough to spring back to be received in an annular groove formed on the inside of the coupling nut. A keeper is received in an annular space between retaining ring and the tubular member. A tab, formed on the keeper, is received in the gap between the ends of the retaining ring. Anti-rotation means are also provided to restrict rotation of the coupling nut with respect to the backshell. One end of the tubular member is formed with an annular shoulder having ratchet teeth. A leaf spring, attached to the inside of the coupling nut, is provided with one or more radially inwardly extending teeth having slopes which cooperate with the ratchet teeth formed on the annular shoulder of the tubular sleeve.

21 Claims, 4 Drawing Sheets

TWO-PIECE RETAINING RING

FIELD OF THE INVENTION

The present invention relates to a two-piece composite retaining ring for axially securing a coupling nut to the end of a tubular sleeve which includes anti-decoupling means for restricting rotation of the coupling nut with respect to the tubular sleeve.

BACKGROUND OF THE INVENTION

The use of a retaining ring to axially secure a coupling nut to a tubular member is generally known in the art. Examples of such arrangements are disclosed in British patent specification 349,329 and U.S. Pat. Nos. 2,383,959; 2,657,078; 2,960,359; 3,446,552; and 3,853,413. Coupling nuts are generally used to connect a tubular member or backshell, used for terminating an electrical cable shield, to an electrical connector. More specifically, some electrical cables are provided with an outer woven metallic shield for protecting the conductors within the electrical cable from electromagnetic interference. The woven metalic shield generally surrounds all the conductors in the electical cable and is terminated to the tubular member. The tubular member is formed with an annular shoulder at one end which forms a bearing surface for the retaining ring. The retaining ring is received in an interior annular groove formed at one end of the coupling nut. The other end of the coupling nut is threaded to allow it to be screwed into an electrical connector forming an electrical connector assembly.

In some known applications, a metal retaining ring, such as steel, is used while the other components are formed from composite materials. The use of a steel retaining ring can cause various problems. For example, it can damage the plating on the composite components and expose the base polymer. Once the base polymer is exposed, the components will be susceptible to damage from certain chemicals or fluids in the environment of the assembly. The plating loss can also cause a loss of electrical conductivity and the danger of shavings falling into the electrical connector or other nearby electrical components. Also it is known that a metal retaining ring can cause harmful grooves in the composite components which result in stress zones.

Another problem associated with electrical connector assemblies is that in some applications, such assemblies may be subject to a substantial amount of vibration. Such vibration can cause rotation of the coupling nut with respect to the tubular member. Such rotation can cause damage to the electrical conductor terminations at the electrical connector.

Various means are known in the art to restrict a coupling nut from rotating with respect to a tubular member. For example, various anti-decoupling means are disclosed in U.S. Pat. Nos. 4,007,953; 4,074,927; 4,165,910; 4,235,498; 4,109,990; 4,268,103; 4,457,469; 4,484,790; 4,487,470; 4,497,530; 4,502,748; 4,519,661; 4,531,801; and 4,648,670.

In Brush et al, U.S. Pat. No. 4,502,748 an electrical connector is disclosed having a coupling nut and a leaf spring mounted on an interior portion of a coupling nut. The leaf spring is provided with a radially inwardly extending tooth which engages an angular slot formed on a cooperating ring. The engagement of the tooth with the slot restricts rotation of the coupling nut with respect to the ring.

Ratchet type anti-decoupling means are also known. In this type of device, the tubular member is formed with an annular shoulder at one end. The annular shoulder is formed with a plurality of ratchet teeth which cooperate with a radially inwardly disposed tooth or protuberance formed on a leaf spring and disposed in a coupling nut. The protuberance cooperates with the ratchet teeth to prevent the coupling nut from freely spinning with respect to the tubular member.

U.S. Pat. No. 4,648,670 also discloses a ratchet type anti-decoupling means, similar to that described above, but which utilizes a gull-wing shaped leaf spring having a central portion and two depending wing portions extending outwardly therefrom. The gull-wing shaped leaf spring is attached to the inside of the coupling nut and includes a radially inwardly disposed protuberance or tooth on each wing portion which cooperate with ratchet teeth.

Although the use of anti-decoupling means including ratchet type is generally known, none of the patents above disclose a structure which allows the coupling nut and the retaining ring to be installed from the front (e.g., over the toothed annular shoulder formed on the tubular member) which facilitates assembly of tubular members having a termination surface with a relatively larger diameter than the inner diameter of the coupling nut and for tubular members formed with 45 and 90 degree angles which generally would not permit the coupling nut ring to be installed from the rear.

SUMMARY OF THE INVENTION

It is an object of the present invention to provide a retaining ring assembly which solves the problems of the prior art.

It is another object of the present invention to provide a retaining ring assembly formed from a composite material.

It is a further object of the present invention to provide a coupling nut and retaining ring assembly with anti-decoupling means, which can be installed from the front.

Briefly, the present invention relates to a two-piece composite retaining ring assembly for axially securing a coupling nut to the end of a tubular sleeve. The two-piece retaining ring assembly includes a C-shaped retaining ring and a keeper, both formed from a composite material. An annular groove is formed on the inside surface of the coupling nut for receiving the retaining ring. The width of the gap defined between the ends of the retaining ring allows the retaining ring to be pulled apart enough to enable the retaining ring to be slipped over the annular shoulder on the tubular member. The retaining ring is also resilient enough to spring back into position after it is received in the annular groove formed on the inside of the coupling nut. A keeper is received in an annular space between retaining ring and the tubular member. A tab, formed on the keeper, is received in the gap between the ends of the retaining ring. Anti-rotation means are also provided to restrict rotation of the coupling nut with respect to the backshell. One end of the tubular member is formed with an annular shoulder having ratchet teeth. A leaf spring, attached to the inside of the coupling nut, is provided with one or more radially inwardly extending teeth having slopes which cooperate with the ratchet teeth formed on the annular shoulder of the tubular sleeve.

BRIEF DESCRIPTION OF THE DRAWING

These and other objects of the present invention will be readily understood with reference to the following drawing and the accompanying text wherein.

DETAILED DESCRIPTION

Figure 1:
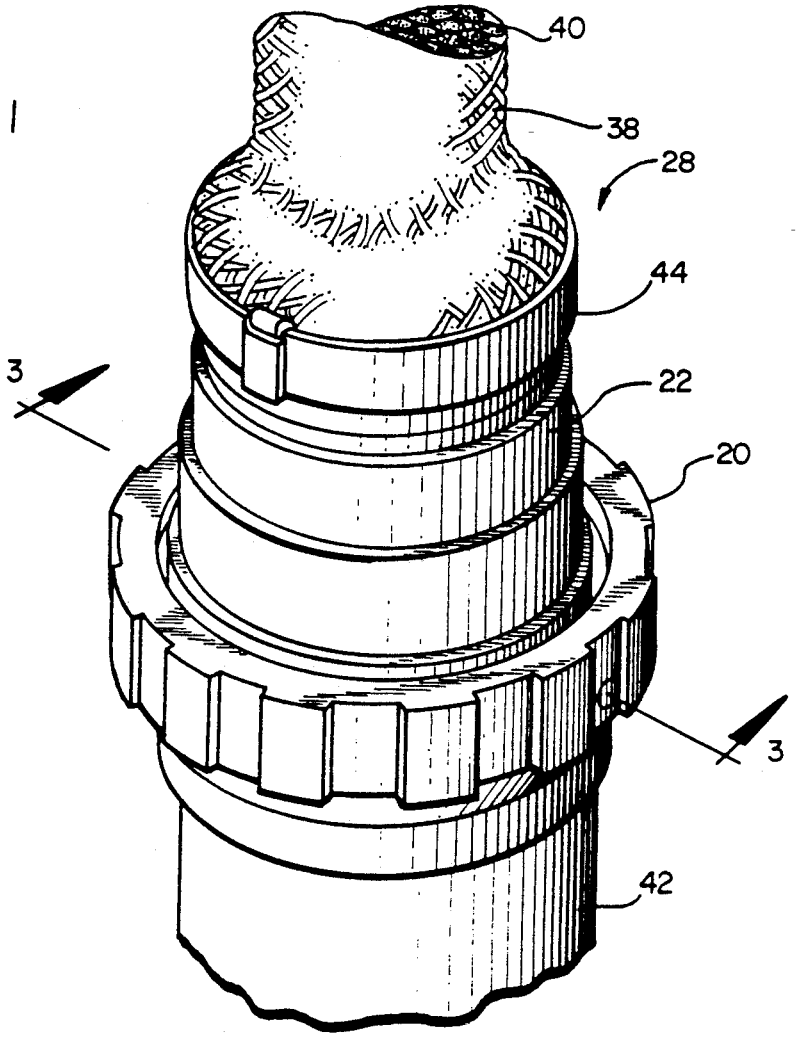
FIG. 1 is a partial perspective view illustrating a backshell assembly with an electrical shield terminated thereto and connected to an electrical connector.
Figure 3:
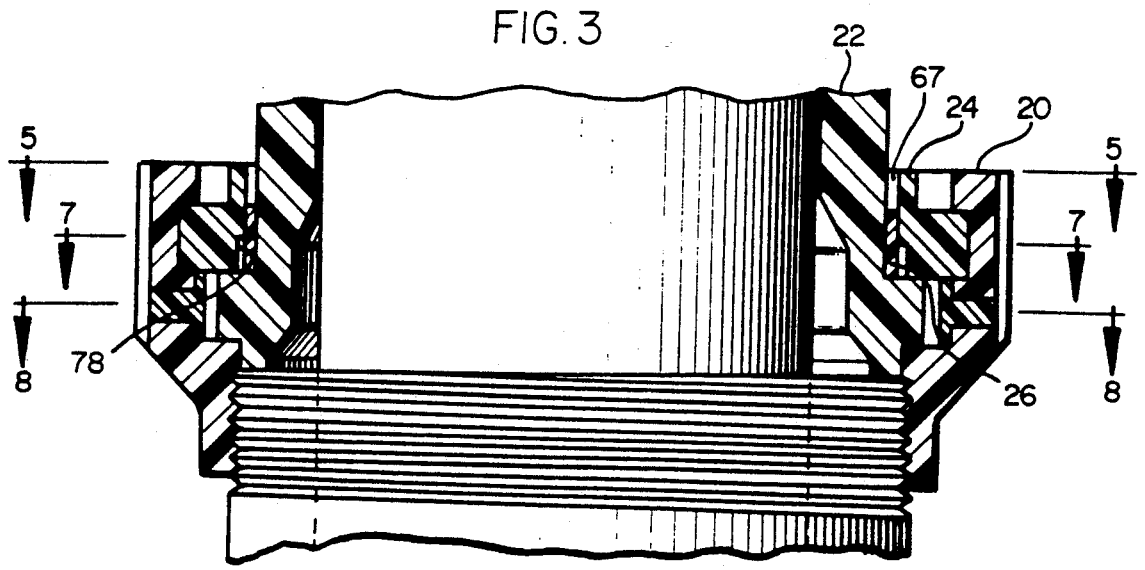
FIG. 3 is an elevational view taken along line 3—3 of FIG. 1.
Figure 2:
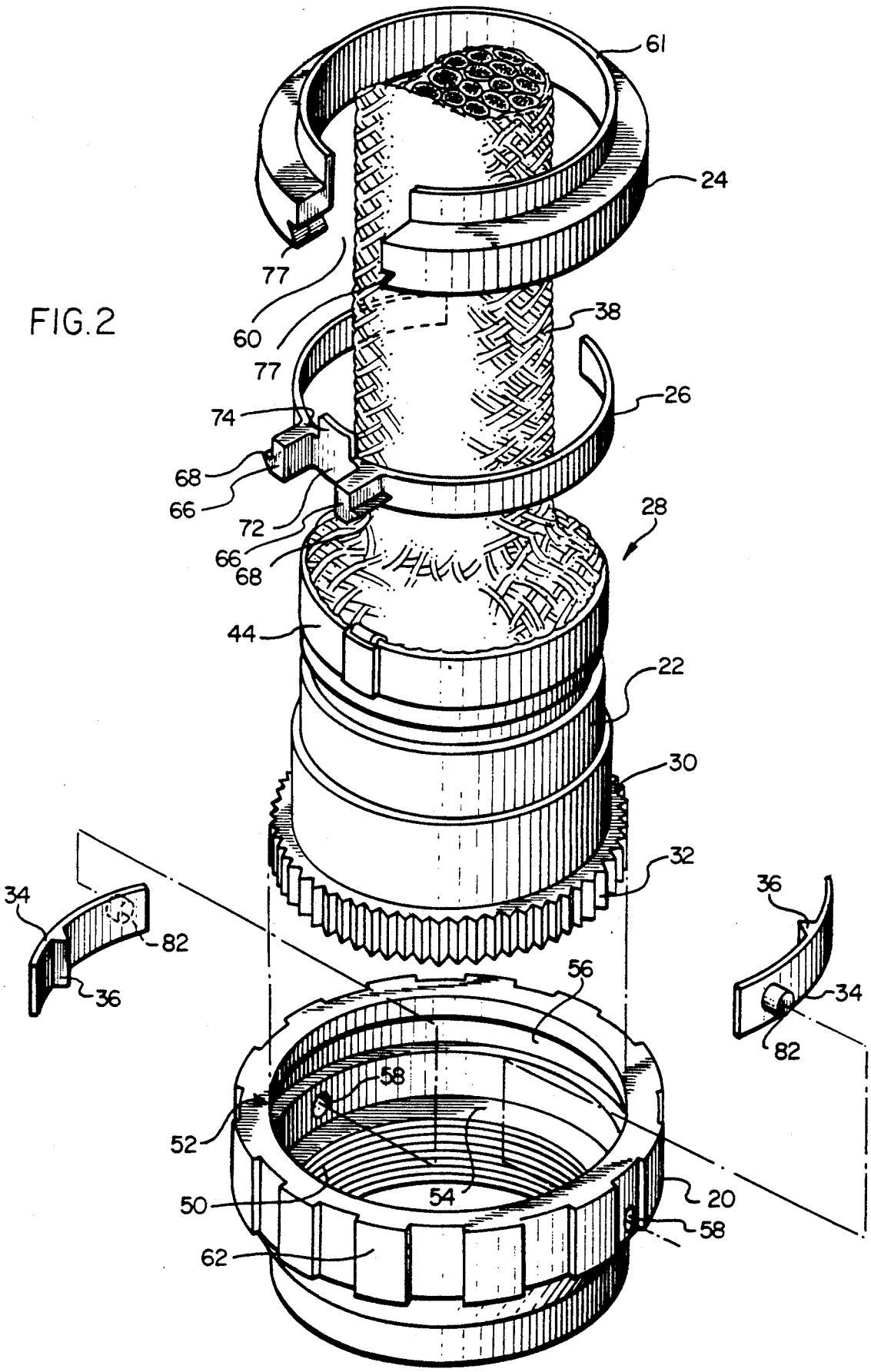
FIG. 2 is an exploded perspective view incorporating the two-piece retaining ring assembly in accordance with the present invention similar to FIG. 1, except the electrical connector is not shown.
Figure 4:
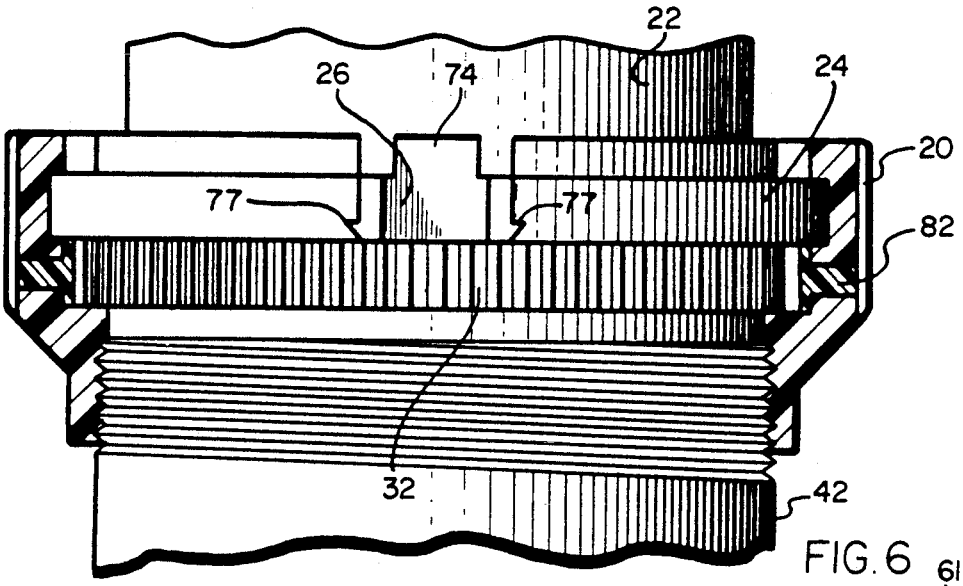
FIG. 4 is a cross-sectional view, similar to FIG. 3.

The two-piece retaining ring in accordance with the present invention is used to axially secure a coupling nut 20 to a tubular sleeve 22. The two-piece retaining ring includes a C-shaped retaining ring 24 and the keeper 26. In order to restrict rotation of the coupling nut 20 with respect to the tubular sleeve 22, one end 28 of the tubular sleeve or backshell 22 is formed with an annular shoulder 30. The annular shoulder 30 is provided with a plurality of ratchet teeth 32 which cooperate with a leaf spring 34. A leaf spring 34 is received within the coupling nut 20 and is provided with one or more teeth 36 which cooperate with the teeth 32 on the annular shoulder 30 to form a ratchet type anti-decoupling mechanism.

The tubular sleeve 22 allows for the termination of a woven metal shield 38 which surrounds an electrical cable assembly having one or more electrical conductors 40. The woven metal shield 38 protects the electrical conductors 40 from electromagnetic interference. The electrical conductors 40 are fed through the tubular sleeve 22 and connected to terminals on the electrical connector 42. The woven metal shield 38 is stripped back and terminated at a termination surface formed on the tubular member 22 with a metal band 44, for example, to provide a good electrical contact between the tubular sleeve 22 and the woven metal shield 38. The metal band 44 may be secured about the woven metal shield 38 with an appropriate banding tool, such as the banding tools of the type disclosed in copending applications Ser. No. 07/277,325, filed on Nov. 29, 1988, and Ser. No. 07/370,597, filed on June 23, 1989, assigned to the same assignee as the present invention.

The tubular sleeve 22 may be integrally molded as a single member or may be formed from a plurality of members. Generally, the tubular sleeve 22 is formed as a single piece when the axis of the electrical cable is parallel to the axis of the tubular sleeve. However, in some applications, the tubular sleeve 22 may have to be formed with an angle, such as 45° or 90°.

As discussed above, the backshell 22 is provided with an annular groove at one end 28 defining a termination surface for the woven metal shield 38. The other end 46 of the backshell 22 is formed with an annular shoulder 30. The annular shoulder 30 cooperates with the retaining ring 24 and the coupling nut 20 to axially secure the coupling nut 20 with respect to the backshell 22.

Since the backshell 22 must serve as a ground plane for the woven metal shield 38, it is necessary that the backshell and certain other components in the assembly be formed from electrically conductive materials. More specifically, there must be an electrical conductive path between the woven metal shield 38 and the ground plane. In some applications the electrical connector 42 is formed with a bulkhead (not shown) which, in turn, is attached to a metal surface which acts as a ground plane. Thus, it is necessary that an electrically conductive path be provided between the woven metal shield 38 and the bulkhead. Accordingly, the backshell 22 as well as the coupling nut 20 are formed from an electrically conductive material. Thus, since the woven metal shield is terminated to the backshell 22 which, in turn, is connected to the coupling nut 20, which is connected to the electrical connector 42, an electrical conductive path will be provided from the backshell to the electrical connector 42. If the electrical connector 42 is provided with a bulkhead, an electrical conductive path is established between the woven metal shield and the bulkhead.

Various materials may be used to form the coupling nut 20 and the backshell 22. For example, various polymers known in the art as "engineering polymers" may be suitable. These components may be formed from a polyetherimide material—a generally nonconductive material—and compounded with a conductive filler, such as carbon or nickel coated carbon fiber. Because of the chemical sensitivity of polyetherimide to certain fluids, components made from such material should be plated. Various materials may be suitable for plating, such as nickel. Other materials may also be suitable such as a polyimideimide. These materials generally have a higher chemical resistance and thus may be used without plating.

Since the electrical conductive path is completed between the connector shell body 42 and the backshell 22, the keeper 48, the retaining ring 24, the coupling nut 20 and the leaf spring 34 may be formed from nonconductive materials. For example, these components can be formed from a polyimide-imide or a liquid crystal polymer. Both the polyimideimide and the liquid crystal polymers have a relatively high chemical resistance and thus do not require plating.

The coupling nut 20 is threaded at one end 50 to allow the coupling nut 20 to be screwed into an electrical connector 42. The threaded end 50 of the coupling nut 20 is formed with a relatively smaller diameter than the other end 52 and defines a shoulder 54 therebetween. The shoulder 54 forms one bearing surface for the annular shoulder 30 formed on the backshell 22. As will be discussed in detail below, the annular shoulder 30 is captured between the shoulder 54 and the retaining ring 24 to axially secure the backshell 22 with respect to the coupling nut 20.

The coupling nut 20 is provided with an annular groove 56. The annular groove 56 is for receiving the retaining ring 24. The coupling nut 20 is also provided with one or more transverse bores 58 for attaching the leaf springs 34 to the coupling nut 20. The outer surface of the coupling nut 20 on the end 52 is formed with a plurality of radially extending flats 62 to facilitate tightening of the coupling nut 20 with respect to the electrical connector 42.

The diameter of the threaded end 50 of the coupling nut 20 is such to allow it to be threaded onto a standard electrical connector 42. The diameter of the other end 52 of the coupling nut 20 allows it to be inserted over the annular shoulder 30 formed on the backshell 22.

In accordance with the present invention, a two-piece retaining ring assembly which includes a C-shaped retaining ring 24 and a keeper 26, is used to axially secure the coupling nut 20 with respect to the backshell 22. Both the retaining ring 24 and the keeper 26 are formed from a composite material as discussed above and thus eliminate the danger for damage to the plated surfaces of the other parts components of the assembly.

An important aspect of the invention relates to the retaining ring 24. The retaining ring 24 serves to locate the coupling nut 20 in the proper longitudinal position and serves to withstand the loads applied to the assembly. The retaining ring 24 is generally C-shaped and is formed with sufficient cross-section to support the load and stress associated with a connector and backshell assembly. The gap 60 defined between the ends of the retaining ring is wide enough to permit the retaining ring 24 to be installed over the shoulder 30 on the backshell 22. This permits the coupling nut 20 and the retaining ring 24 to be installed from the front even after the woven metal shield 38 has been terminated to the backshell 22. This is an important aspect of the invention and greatly facilitates installation. It also permits the coupling nut 20 to be installed on 45 and 90 degree backshells 22 and straight backshells in which the rearmost diameters are larger than the inner diameter of the coupling nut. The retaining ring 24 also is formed with sufficient resilience to allow it to spring back into position when pushed into the annular groove 56 in the coupling nut 20. The outer diameter of the retaining ring 24 is substantially equivalent to the diameter of the annular groove 56 formed in the coupling nut 20. The inner diameter of the retaining ring 24 in a relaxed position is relatively smaller than the diameter of the annular shoulder 30 formed on the backshell 22. This allows the retaining ring 22 to act as the other bearing surface for the shoulder 30. When the retaining ring 24 is inserted in the annular groove 56, the annular shoulder 30 will be captured between the shoulder 54 in the coupling nut and the retaining ring 24. The retaining ring 24 may also be formed with a raised lip portion 61. This raised lip portion 61 serves to eliminate the possibility of the retaining ring 24 being inserted into the assembly upside down.

Another important aspect of the invention relates to the keeper 26. The keeper 26 serves two purposes. First, the keeper 26 maintains the ends of the retaining ring 24 spread open to their maximum limit to maintain the retaining ring 24 in intimate contact with the annular groove 56 formed in the coupling nut 20 and hence, at full loading capacity. The keeper 26 also serves to circumferentially locate the top end of the coupling nut 20 about the backshell 22 by creating a bearing surface at the inner diameter of the keeper 26 with respect to the outer diameter of the backshell 22.

As best shown in FIGS. 3, 5, 6 and 7, the keeper 26 is disposed in an annular space 67 between the outer diameter of the backshell 22 and the retaining ring 24. The keeper 26 is formed as a generally C-shaped member having sufficient diameter to allow it to be disposed between the inner diameter of the retaining ring 24 and the outer diameter of the backshell 22. The keeper 26 is formed with a pair of radially extending, spaced apart tabs 66. Each tab 66 is formed with a barb portion 68, adapted to be received in a complementary female recesses 77 integrally formed in the ends of the retaining ring 24 to capture the tabs 66 with respect to the retaining ring 24.

An annular portion 72 of the keeper 26 between the tabs 66 may be formed with a relatively thinner cross-sectional material to allow for spring action of the keeper 26. This portion 72 may also be formed with a raised tab 74 which indicates the top of the keeper 26 with respect to the retaining ring 24.

Figure 6:
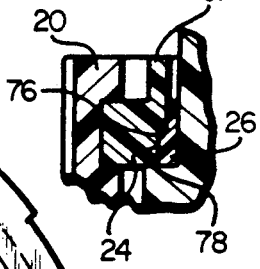
FIG. 6 is a partial cross-sectional view along line 6—6 of FIG. 5.
Figure 5:
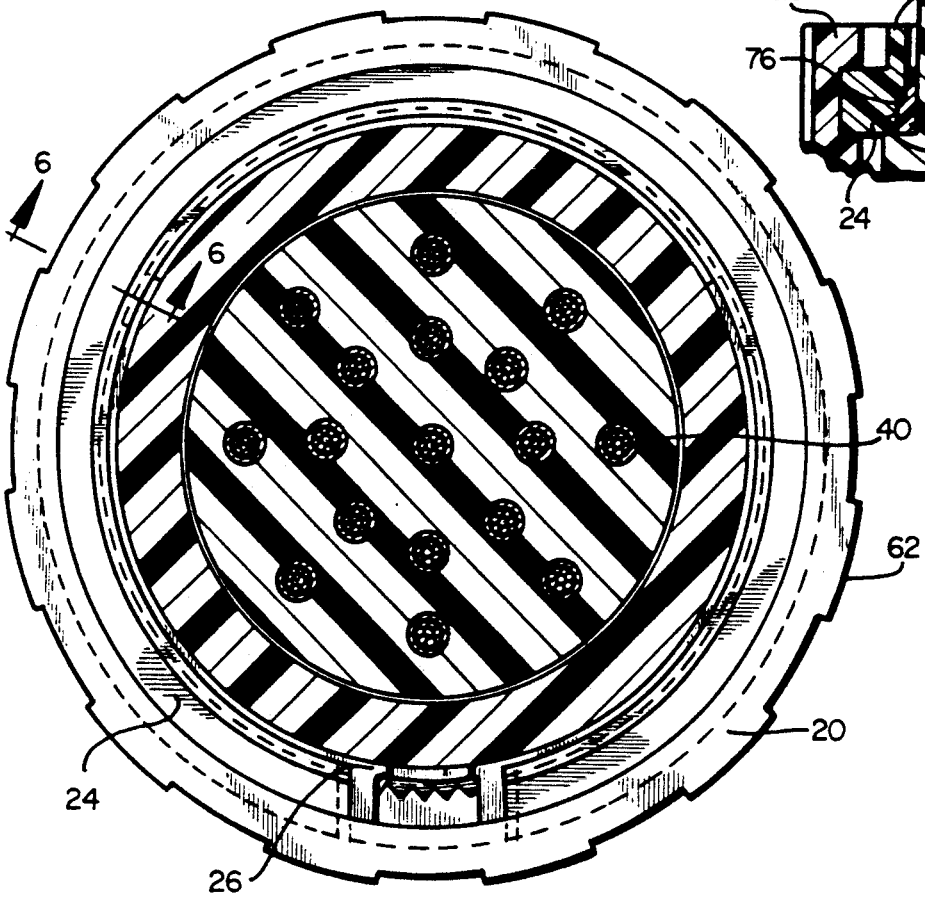
FIG. 5 is a plan sectional view taken along line 5—5 of FIG. 3.
Figure 7:
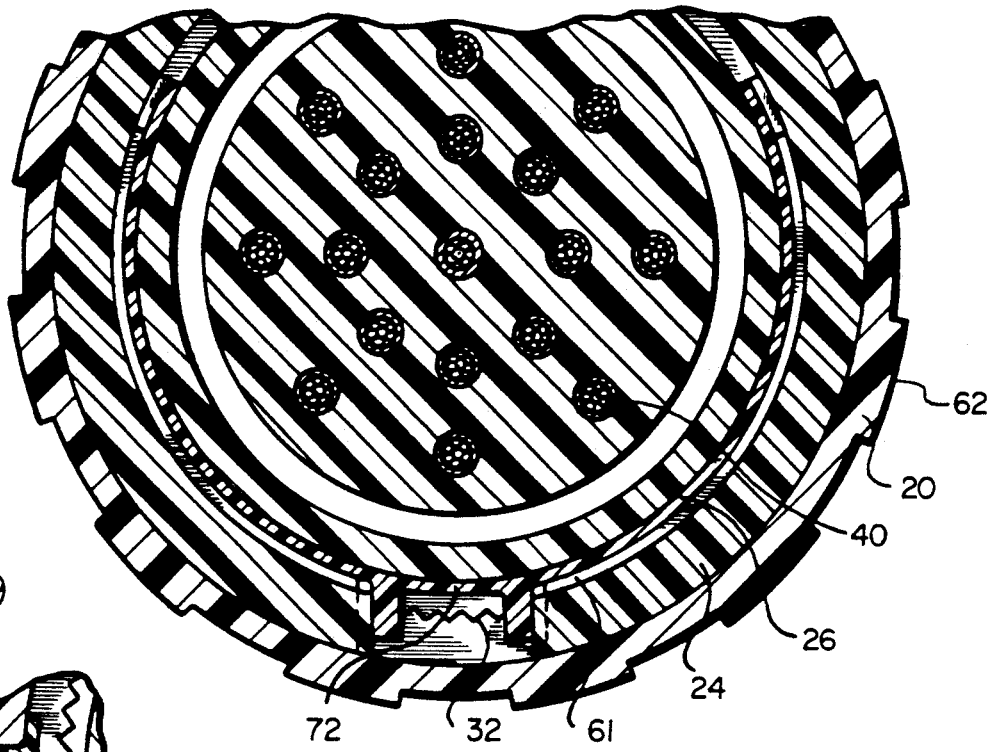
FIG. 7 is a partial plan elevational view along line 7—7 of FIG. 3.
Figure 9:
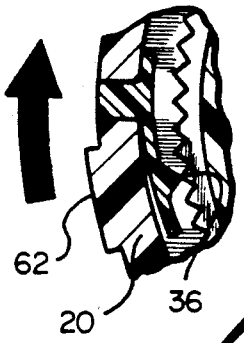
FIG. 9 is a partial cross-sectional view illustrating the anti-decoupling means.
Figure 8:
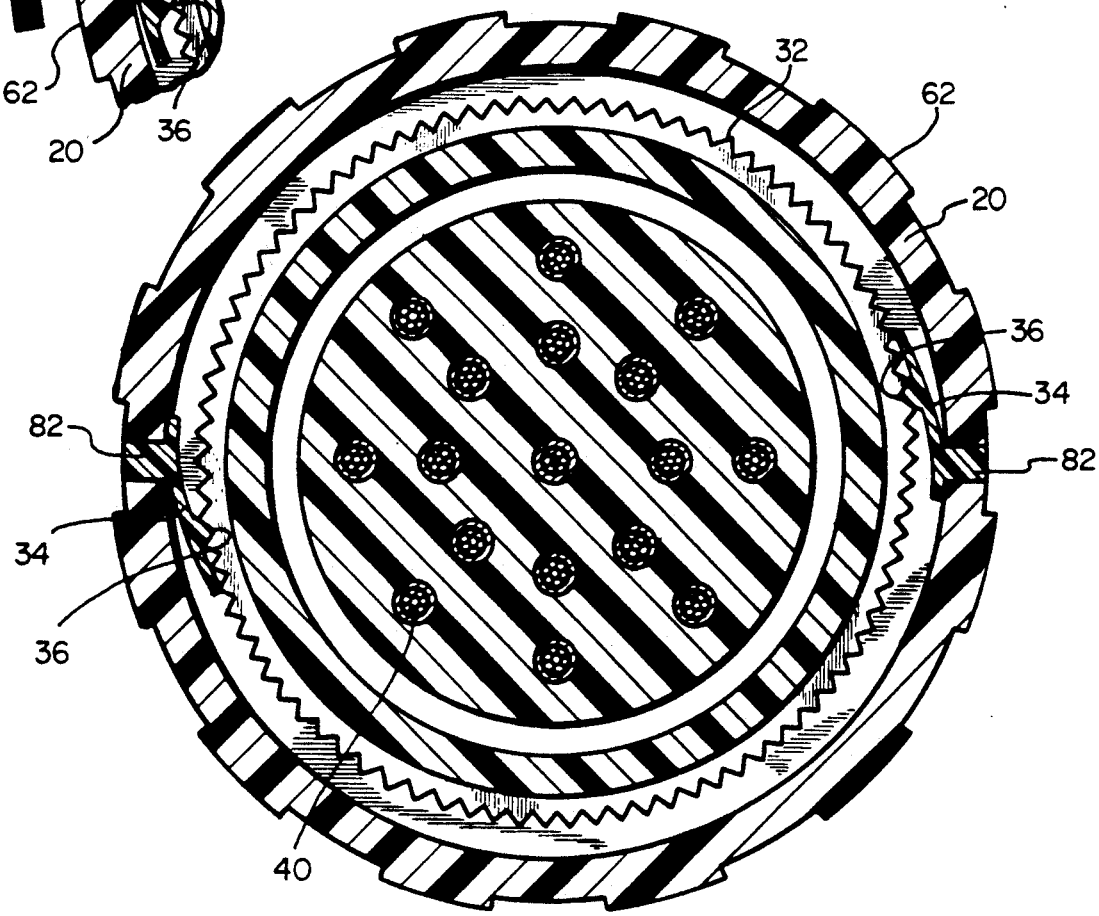
FIG. 8 is a sectional view along line 8—8 of FIG. 3, similar to FIG. 7.

As best shown in FIG. 6, the ends of the keeper 26 are formed with a radially extending tabs 76, adapted to be received in an annular undercut 78 provided in the retaining ring 24. This prevents the ends of the keeper 26 from working out of position under load or vibration.

Another important aspect of the invention relates to the anti-decoupling means. The anti-decoupling means restricts rotation of the coupling nut 20 with respect to the backshell 22. Such rotation, which can be caused by vibration, can damage the electrical integrity of the connector 42/backshell 22 interface. The anti-decoupling means includes one or more arcuately-shaped leaf springs 34. Each leaf spring is provided with one or more teeth 36. These teeth 36 cooperate with the ratchet teeth 32 formed on the annular shoulder 30 of the backshell 24. The teeth 36 are disposed adjacent one end of the leaf spring 34. A radially, outwardly extending stud 82 is formed adjacent the end opposite the teeth 36. The stud 82 is adapted to be received in the transverse bores 58 in the coupling nut 20.

It should be understood that although a particular embodiment of the invention has been shown and illustrated, it is to be understood that the present invention is not intended to be so limited. As will be appreciated by those of ordinary skill in the art, the spirit and scope of the appended claims are intended to cover various embodiments, all considered to be within the broad scope of the invention.

What is claimed and desired to be secured by Letters Patent is:

1. A retaining ring assembly for axially securing a coupling nut, formed with an interior annular groove to a tubular sleeve comprising:

a C-shaped retaining ring; and means at least partially disposed in said gap and at least partially disposed between said C-shaped retaining ring and said tubular sleeve for keeping said ends spread apart after said retaining ring is received in said annular groove.

2. A retaining ring assembly as recited in claim 1, wherein said keeping means includes means for identifying the top side of the keeping means.

3. A retaining ring assembly as recited in claim 1, wherein said retaining ring is formed from a liquid crystal polymer.

4. A retaining ring assembly as recited in claim 1, wherein said retaining ring is formed of polyimide-imide.

5. A retaining ring assembly as recited in claim 1, wherein said keeping means is formed from a liquid crystal polymer.

6. A retaining ring assembly as recited in claim 1, wherein said keeping means is formed of polyimide-imide.

7. A retaining ring as recited in claim 1, wherein said material is a composite material.

8. A retaining ring assembly for axially securing a coupling nut, formed with an interior annular groove, to a tubular sleeve comprising:

a C-shaped retaining ring defining two ends separated by a gap, adapted to be received in said annular groove;

means for keeping said ends spread apart after said retaining ring is received in said annular groove, said keeping means being formed as a C-shaped member defining two ends having first capturing means for capturing said keeping means with respect to said retaining ring; and wherein said retaining ring and said keeping means are formed from a non-metallic material.

9. A retaining ring assembly as recited in claim 8, wherein said capturing means includes one or more radially extending barbs formed on said keeping means and cooperating complementary recesses formed in said retaining ring.

10. A retaining ring assembly as recited in claim 8, wherein said keeping means is adapted to be disposed between said tubular sleeve and said coupling nut.

11. A retaining ring assembly for axially securing a coupling nut, formed with an interior annular groove, to a tubular sleeve comprising:

a C-shaped retaining ring defining two ends separated by a gap, adapted to be received in said annular groove;

means for keeping said ends spread apart after said retaining ring is received in said annular groove, said keeping means including means for identifying the top side of the keeping means and wherein said identifying means includes an axially extending tab formed on a portion of the keeping means; and wherein said retaining ring and said keeping means are formed from a non-metallic material.

12. A retaining ring assembly as recited in claim 8, wherein said keeping means includes second capturing means for capturing the ends of the keeping means with respect to the retaining ring.

13. A retaining ring assembly as recited in claim 12, wherein said second capturing means includes one or more radially extending tabs.

14. A retaining ring assembly as recited in claim 13, wherein said retaining ring is formed with an undercut for capturing said one or more radially extending tabs.

15. A retaining ring assembly as recited in claim 13, wherein said tabs are disposed on said ends of said keeping means.

16. A retaining ring assembly as recited in claim 13, wherein said tabs are disposed intermediate the ends of said keeping means.

17. An assembly for connecting a shielded electrical cable having an electrical shield to an electrical connector comprising:

a tubular sleeve having an annular groove defining a termination surface for the electrical shield and having an exterior annular shoulder at one end defining a bearing surface;

a coupling nut adapted to couple said tubular sleeve to said electrical connector including an interior annular groove and an interior annular shoulder;

a retaining ring defining two ends separated by a gap, adapted to be received in said annular groove in said coupling nut such that said exterior annular shoulder on said tubular sleeve is captured between said interior annular shoulder and said retaining ring; and means at least partially disposed in said gap and at least partially disposed between said retaining ring and said tubular sleeve for keeping said ends spread apart after said retaining ring is received in said annular groove.

18. An assembly as recited in claim 17, further including anti-decoupling means for restricting rotation of said coupling nut with respect to said tubular sleeve.

19. An assembly as recited in claim 18, wherein said anti-decoupling means includes one or more leaf springs disposed in said coupling nut.

20. An assembly as recited in claim 19, wherein said anti-decoupling means includes a plurality of ratchet teeth formed on the exterior annular shoulder on the tubular sleeve.

21. An assembly as recited in claim 20, wherein said coupling nut is formed with an inner diameter slightly larger than the outer diameter of said ratchet teeth.

* * * * *